US005746221A

United States Patent [19]

Jones et al.

[11] Patent Number: 5,746,221

[45] Date of Patent: May 5, 1998

[54] COLD FORMABLE MOUTHGUARDS

[75] Inventors: Carl H. Jones, Katy, Tex.; John M. Blaha, Chesapeak City, Md.; Gail J. Townsend, Newark, Del.

[73] Assignee: W. L. Gore & Associates, Inc., Newark, Del.

[21] Appl. No.: 746,801

[22] Filed: Nov. 18, 1996

[51] Int. Cl.[6] ..... A61C 5/14

[52] U.S. Cl. ..... 128/859; 128/861; 128/862

[58] Field of Search ..... 128/848, 859–862; 602/902; 2/2

[56] References Cited

U.S. PATENT DOCUMENTS

| | | | |
|---|---|---|---|
| 1,934,688 | 11/1933 | Ackerman | 128/861 |
| 4,896,664 | 1/1990 | Harayama | 128/201.11 |
| 5,152,301 | 10/1992 | Kittelsen et al. | 128/861 |
| 5,234,005 | 8/1993 | Kittelsen | 128/859 |
| 5,339,832 | 8/1994 | Kittelsen et al. | 128/862 |
| 5,360,341 | 11/1994 | Abramowitz | 433/215 |
| 5,406,963 | 4/1995 | Adell | 128/861 |
| 5,570,702 | 11/1996 | Forman | 128/859 |

OTHER PUBLICATIONS

Literature: Spiro J. Chaconas, Angelo A. Caputo, Niles K. Bakke, "A Comparison of Athletic Mouthguard Materials," The American Journal of Sports Medicine, vol. 13, No. 3, 1985, pp. 193–197.

Literature: Bureau of Health Education and Audiovisual Services Council on Dental Materials, Instruments, and Equipment, Mouth protectors and Sports team dentists, JADA, vol. 109, Jul. 1984.

ASTM Designation: F 697–80, Standard Practice for Care and Use of Mouthguards, 1992.

John M. Stenger, Edward A. Lawson, Jack M. Wright, James Ricketts, "Mouthguards: Protection against shock to head, neck and teeth," JADA, vol. 69, Sep. 1964, pp. 273–281.

Robert E. Golng, Ronald E. Loehman, Ming Sam Chan, "Mouthguard materials: their physical and mechanical properties," JADA, vol. 89, Jul. 1974, pp. 132–138.

B. Westerman, P. M. Stringfellow, J. A. Eccleston, "Forces transmitted through EVA mouthguard materials of different types and thickness," Australian Dental Journal 1995; 40:6, pp. 389–391.

I. Lawrence Kerr, "Mouth Guards for the Prevention of Injuries in Contact Sports," Sports Medicine, 415–427 (1986).

Raymond A. Flanders, "Mouthguards and Sports Injuries," Illinois Dental Journal, Jan.–Feb. 1993, pp. 13–16.

David W. Johnson, Barrett J. Parker, "Athletic Mouth Guards—One Town's Approach," CDA Journal, Apr. 1993.

Ray Padila, Stewart Balikov, "Sports Dentistry: Coming of Age in the '90s," CDA Journal, Apr. 1993, pp. 27, 29, 31, 33, 36.

Chris Smith, "The Sporting Life," AGD Impact/Nov. 1989, pp. 4, 6, 8.

"MouthGuards On–Line!", Internet, Jan. 26, 1996.

*Primary Examiner*—Michael A. Brown

*Attorney, Agent, or Firm*—Carol A. Lewis White

[57] ABSTRACT

The present invention relates to cold formable mouthguards that provide protection to the teeth, gums, jaw, and joints of the facial region and absorb and dissipate energy that would otherwise be transferred to the jaw, joints and brain, thus minimizing further injuries. A novel feature of the present invention is that the mouthguard can be shaped to retain the contours of the teeth and mouth by simply placing the mouthguard into the mouth and biting down, without the need for first boiling to soften or other complicated shaping step as is required in the prior art.

19 Claims, 3 Drawing Sheets

COLD FORMABLE MOUTHGUARDS

BACKGROUND OF THE INVENTION

1. Field of the Invention

The present invention relates to cold formable mouthguards that provide protection to the facial region and absorb and dissipate energy resulting from impact.

2. Description of Related Art

Facial trauma experienced by athletes has been demonstrably reduced by the use of a mouthguard during participation in athletic events. These mouthguards, or mouth protectors, provide protection against injuries to the teeth, lips, cheeks, and gums, and may also reduce the incidence of head and neck injuries, concussions, and jaw fractures.

A number of mouthguards currently exist in the art for protecting against the injuries described above. The American Society for Testing and Materials has classified mouthguards into three types: stock mouthguards, mouth-formed mouthguards, and custom-fabricated mouthguards. Some of these mouthguards are fitted with a tether or strap to connect them to a fastening point, such as a helmet or the like, to prevent loss, swallowing or choking on the mouthguard by the user. Generally, mouth protectors are fabricated to cover all teeth of the maxillary arch, except for the erupting third molars. To provide maximum protection, it is believed that the energy absorbed by the mouth protector must be dissipated by the protector, rather than transferred to the underlying tooth and jaw structure.

Stock mouthguards typically can be purchased at sporting goods stores, department stores and pharmacies. These mouthguards may be made of rubber, polyvinyl chloride, or polyvinyl acetate copolymer and are typically available in small, medium, and large sizes. These stock mouthguards are not in any way molded or "fit" to the persons wearing them and, as a result, can be loose and uncomfortable for the user. Often the mouth must be closed in order to hold them in place, and, not surprisingly, many athletes find them bulky and uncomfortable. In addition, these mouthguards can interfere with speech and breathing, which is a further strong disincentive for athletes to wear these mouthguards. The one benefit to these mouthguards is that they are inexpensive.

Mouth-formed mouthguards are fitted by the user. They are molded to fit the individual wearer either by the use of a moldable inner liner typically of plasticized acrylic gel or silicone rubber, or the use of a moldable thermoplastic that softens when immersed in boiling water and sets when cooled. The thermoplastic mouthguard is also known as the "boil-and-bite" mouthguard. However, repeated biting during participation in athletic events or gnawing due to nervousness before or during an athletic event can cause the material to spread resulting in a loose fit. In addition, aging and/or continual exposure to oral fluids may cause the plasticizers to leach out causing the liner to become hard.

Custom-made mouthguards are considered to be the best of the conventional mouthguards as far as fit, shape retention and comfort are concerned, but they are also the most expensive. This type of mouthguard tends to not have the bulk of the other two types and may stay in position better. Custom mouthguards are typically composed of a thermoplastic polymer, of which the most popular type is ethylene/vinyl acetate copolymer, although acrylic resin, polyurethane, and various rubber materials are also used. Custom-made mouthguards are fabricated by molding over a cast of a person's dentition, and most often this process is done by a dentist or in a dental laboratory. There are usually four steps required in the making of a custom-fit mouthguard: 1) making an impression of the maxillary arch; 2) pouring a cast; 3) forming the thermoplastic material on the cast; and 4) finishing the protector.

The mouthguards described above are typically U-shaped to match the general shape of the upper dental arch and have upward inner lingual and outer labial walls extending therefrom. Bi-maxillary mouthguards are also available which have protection for both dental arches and hold the mouth in a pre-determined position to allow for maximum breathing capability.

Since 1950 the American Dental Association (ADA) has been active in promoting the use of mouth protectors. In addition to preventing injuries to the teeth, gums, and facial area, the mouthguard is believed to be responsible for reducing the number of concussions and neck injuries suffered by athletes. One study by the ADA using a cadaver showed that a mouth protector reduced the amplitude of the intercranial pressure wave and decreased the amount of bone deformation by as much as 50%.

The American Dental Association and other respected sports medicine organizations have published reports of energy absorption values for conventional materials, such as polyvinyl acetate-polyethylene, polyvinyl chloride, and the like, which are typically used in commercial mouthguards, which indicate that these materials absorb only approximately 50–65% of the energy of impact.

Recent improvements in mouthguard performance relate to improved energy absorption. For example, U. S. Pat. No. 5,339,832, to Kittelsen et al., is directed to a thermoplastic mouthguard with an integral shock absorbing framework. The composite mouthguard of Kittelsen et al. comprises a U-shaped mouthguard portion made of a softenable thermoplastic and a shock absorbing and attenuating low compression elastomer framework embedded in the U-shaped mouthguard portion. The shock-absorbing insert portion of the mouthguard attenuates and dissipates shock forces exerted on the mouthguard during athletic activity.

However, even with the improvements described by Kittelsen et al., the mouthguard described is still of the "boil-and-bite" type and requires that the user have access to facilities which permit boiling of the mouthguard in order to form it to the user's mouth.

As will become apparent from the following description, the present invention is a novel, cold formable mouthguard which may be molded to conform to the shape of a mouth and which provides excellent energy absorption and dissipation when subjected to force such as that experienced during athletic activity, without the requirement for complicated forming techniques, such as molding an inner liner or requiring a "boil-and-bite" procedure.

SUMMARY OF THE INVENTION

The present invention relates to cold formable mouthguards that provide protection to the teeth, gums, jaw, and joints of the facial region and absorb and dissipate energy that would otherwise be transferred to the jaw, joints and brain, thus minimizing further injuries. A novel feature of the present invention is that the mouthguard can be shaped to retain the contours of the teeth and mouth by simply placing the mouthguard into the mouth and biting down, without the need for first boiling to soften or other complicated shaping step as is required in the prior art.

A significant benefit of the novel mouthguard of the present invention is the superior energy absorption relative to conventional materials. Results of ASTM D1054-91, Standard Test Method for Rubber Property-Resilience Using a Rebound Pendulum, indicate that the expanded PTFE materials of the present invention absorb approximately 75%, or higher, of impact energy, while conventional materials used in commercial mouthguards typically absorb only approximately 50–65% of the energy.

Another benefit of the present invention, as mentioned above, is that there is no requirement for softening the mouthguard prior to shaping. Thus, the mouthguard can be removed from the package and placed directly in the mouth to mold. The pressure exerted by the jaws upon biting down by the user will shape and mold the mouthguard to the teeth. Accordingly, in addition to the performance benefits of the novel mouthguard of the present invention, it is much easier for athletes to shape to the contours of the mouth, and thus, is more likely to be used by athletes when participating in athletic events than conventional formable mouthguards.

The novel mouthguard of the present invention comprises an expanded PTFE material. Depending on the desired properties of the mouthguard, it may also include an elastomeric coating or matrix on or in at least a portion of the mouthguard in order to provide enhanced resilience, shape retention, toughness, and the like. In another embodiment of the present invention, the expanded PTFE material may include one or more fillers in at least a portion thereof in order to enhance the performance, appearance, etc. of the mouthguard. In a further embodiment of the present invention the mouthguard may comprise a combination of expanded PTFE and a material having a different composition in order provide enhanced dissipation of shock upon impact, to provide shape retention, and the like.

DETAILED DESCRIPTION OF THE INVENTION

The present invention is a cold formable mouthguard that provides protection to the teeth, gums, jaw, and joints of the facial region and absorbs and dissipates energy from impacts received during sporting events that would otherwise be transferred to the jaw, joints and brain, thus reducing injuries. A novel feature of the present invention is that the mouthguard can be cold formed or shaped to retain the contours of the teeth and mouth by simply placing the mouthguard into the mouth and biting down, without the need for first boiling to soften or other complicated shaping steps which are required in the prior art.

When the mouthguard is placed in the mouth and a biting force is applied by the user, the soft sections are compressed and fit the contour and impressions of the teeth. Slight pressure from fingertips along the outside of the mouthguard may be beneficial to help conform the mouthguard to the frontal teeth and gum area. The ability to be cold formed allows the mouthguard to be formed and used without any prior preparation, which can be particularly beneficial when athletes lose or forget to bring their mouthguard to the playing field, or when their mouthguard becomes damaged during use.

Figure 1:
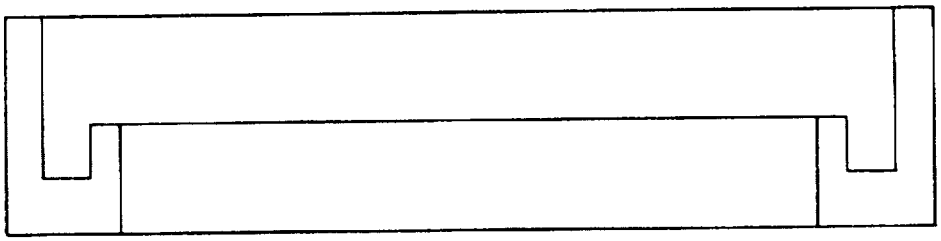
FIG. 1 is a rear planar schematic view of one embodiment of a mouthguard of the present invention.
Figure 2:
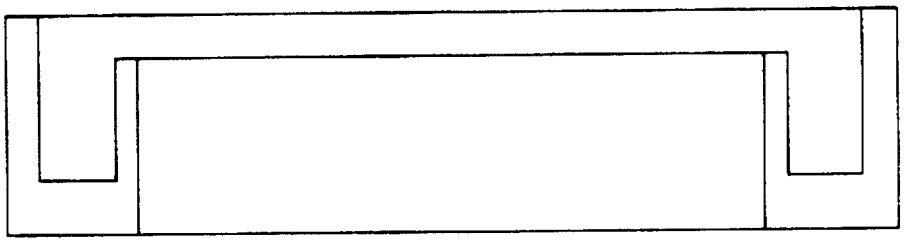
FIG. 2 is a rear planar schematic view of another embodiment of a mouthguard of the present invention.

The novel mouthguards of the present invention typically have an overall U-shaped dimension to match the dimensions of the dental arches and may have a "U-shaped", or a "J-shaped" cross-section, or any other desirable cross-section that fits the shape of a user's dentition. FIGS. 1 and 2 show representative planar perspective rear views of mouthguards which may be made in accordance with the present invention. In both of these Figures, the mouthguard is shown to have an overall U-shaped dimension to match the shape of the upper dental arch and a J-shaped or U-shaped cross-section wherein the inner lingual wall is shorter than the outer labial wall.

Figure 3:
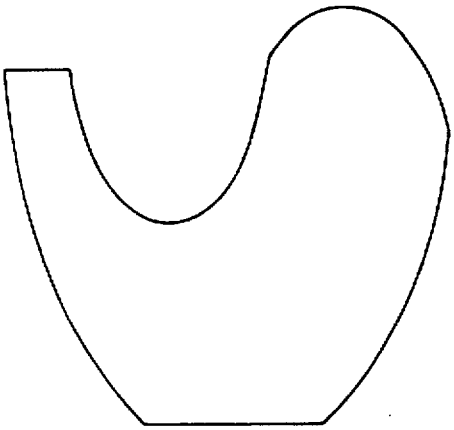
FIG. 3 is a cross-sectional view of a mouthguard of the present invention.
Figure 4:
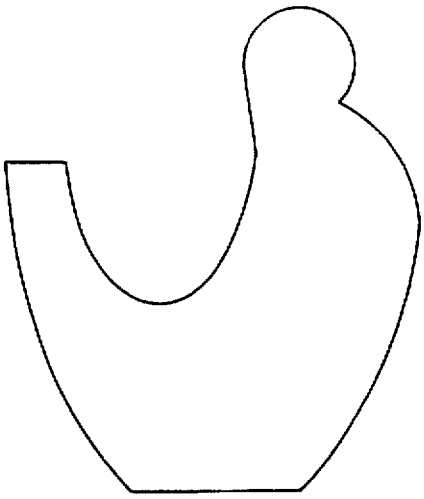
FIG. 4 is a cross-sectional view of a mouthguard of the present invention having a upwardly extending bulb region.

FIGS. 3 and 4 show cross-sectional views of alternative suitable geometries for the mouthguards of the present invention. These cross-sectional shapes help hold the mouthguard in position and provide protection for the front teeth. As shown in FIG. 4, a bulb may be incorporated on the outer labial wall to help the mouthguard fit into the area between the upper lip and the gums, thus further assisting with the positioning of the mouthguard. Depending on the desired performance of the mouthguard, the thickness of the base of the cross section can be modified to provide additional cushion between upper and lower teeth.

A significant benefit of the novel mouthguard of the present invention is the superior energy absorption relative to conventional mouthguards such as ethylene vinyl acetate copolymer. Results of ASTM D1054-91, Standard Test Method for Rubber Property-Resilience Using a Rebound Pendulum, indicate that the expanded PTFE materials of the present invention absorb approximately 75%, or higher, of impact energy.

Another benefit of the present invention, as mentioned above, is that there is no requirement for softening the mouthguard prior to shaping. Thus, the mouthguard can be removed from the package and placed directly in the mouth to mold. The pressure exerted by the jaws upon biting down by the user will shape and mold the mouthguard to the teeth. Thus, in addition to the performance benefits of the novel mouthguard of the present invention, the mouthguard is very easy for athletes to shape to the contours of the mouth, and thus, is more likely to be used by athletes when participating in athletic events than conventional formable mouthguards.

The novel mouthguard of the present invention comprises an expanded polytetrafluoroethylene (PTFE) material, which exhibits particularly desirable properties under a wide variety of highly demanding conditions. As is disclosed in, for example, U.S. Pat. No. 3,953,566 to Gore, which is specifically incorporated herein by reference, expanded PTFE is an excellent material for use in a variety of applications due to its high strength, inertness, conformability, low-friction surface, and non-hazardous by-products. However, to date, no one has taught the use of expanded PTFE as a mouthguard material. The structure of the expanded PTFE provides a high tensile strength material that is both soft and cushioning. The softness allows the user to easily mold the mouthguard to his teeth without the need for any special preliminary softening steps and provides a comfortable fit, while the strength of the material provides enhanced protection during use.

Depending on the desired properties of the mouthguard, it may also be desirable to include a resilient coating or matrix on or in at least a portion of the mouthguard in order to provide enhanced resilience, shape retention, toughness, and the like. The expanded PTFE structure can be impregnated with resilient materials including, but not limited to, elastomers such as silicone, natural latex rubbers, and the like. The resilient material may be uniformly or selectively applied to areas of the mouthguard. Selective application of such resilient materials may be carried out to produce areas having differing properties or textures such as, for example, softness in one region and rigidity in a different region. The resilient materials may be applied by any suitable technique, such as dipping, spraying, brushing, or the like. The use of different elastomeric materials in different areas can produce regions of the mouthguard that may be stiffer to provide, for example, shape retention for ease of insertion into the mouth and other regions which may be softer to provide, for example, enhanced energy absorption upon impact. Additionally, different elastomers can be applied in one or more layers to produce an effect of a stiffness/softness gradient through a region of the expanded PTFE.

In another embodiment of the present invention, the expanded PTFE material may include one or more fillers in at least a portion thereof in order to enhance the performance, appearance, etc. of the mouthguard. U. S. Pat. No. 4,985,296, which is specifically incorporated herein by reference, teaches the formation of expanded PTFE materials having one or more fillers incorporated therein. In the novel mouthguards of the present invention, it may be desirable to incorporate one or more fillers to enhance the appearance of the mouthguard, such as by altering the color, pattern, etc., of the mouthguard. For example, pigments may be used to provide desired colors, sparkles, patterns, textures, etc., which would be attractive to athletes, particularly to young athletes. Alternatively, one or more fillers may be incorporated into the expanded PTFE material in order to enhance the strength, resilience, texture, stiffness, etc., of the mouthguard. Further, fillers may be added which provide desirable flavors to the mouthguard. The fillers used in the present invention may be incorporated uniformly throughout the expanded PTFE or may be preferentially located in only a certain portion or portions of the mouthguard.

Moreover, it may be desirable to imprint names, logos, or any other conceivable configuration on the surface of the mouthguard. For example, as disclosed in commonly owned PCT Publication WO 96/22565, the subject matter of which is specifically incorporated herein by reference, it may be desirable to print a design or pattern onto the surface of an expanded PTFE material.

Figure 5A:
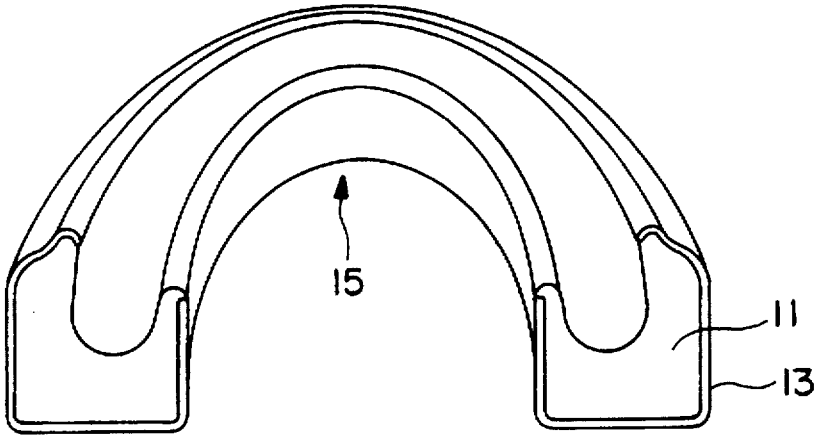
FIGS. 5A and 5B are rear perspective views of exemplary configurations of the mouthguards of the present invention.
Figure 5B:
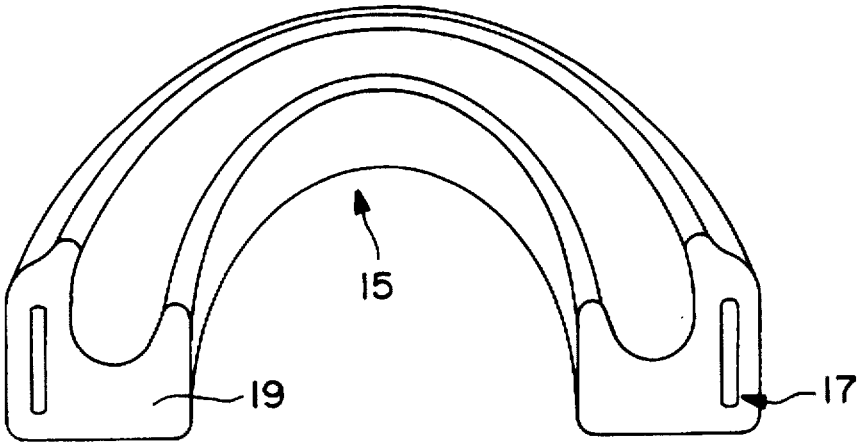

In a further embodiment of the present invention, such as is shown in cross-section in FIG. 5A, the mouthguard 15 may comprise an inner region of expanded PTFE 11 within a outer portion or shell 13 which covers at least a portion of the surface of the mouthguard and which comprises a different composition. For example, the mouthguard could comprise a shell of ethylene vinyl acetate or other plastic, an elastomer, an imbibed PTFE layer, or the like, incorporating a soft expanded PTFE inner region which permits cold formability and provides enhanced impact resistance. Alternatively, as shown in, for example, FIG. 5B, the mouthguard 15 could comprise one or more inserts 17 located at an edge or within at least a portion of the expanded PTFE region 19. Moreover, any combination of these configurations could be used to form the novel mouthguards of the present invention.

In a preferred embodiment of the present invention, the mouthguards of the present invention may be formed in the following manner. First, an expanded PTFE material is produced, such as through the methods described in U.S. Pat. Nos. 3,953,566 to Gore; 3,962,153 to Gore; 4,096,227 to Gore; and 4,187,390 to Gore, each of which is incorporated herein by reference. For example, an expanded PTFE tube may be formed from a mixture of PTFE resin (having a crystallinity of about 95% or above) and a liquid lubricant (e.g., a solvent of naphtha, white oil, mineral spirits, or the like). The mixture is thoroughly blended and then dried and formed into a pellet. The pellet is extruded into a desired shape through a ram-type extruder. Subsequently, the lubricant may be removed through evaporation in an oven. The resulting extruded shape may be subjected to uniaxial or biaxial stretching at a temperature of less than 32° C. to impart the desired amount of porosity and other properties to the material. Stretching may be performed through one or more steps, at amounts varying from 1:1 or less up to 45:1. The resulting shape may then be subjected to a sintering temperature above 345° C. (i.e., the melting temperature of PTFE) to amorphously lock the material in its expanded orientation.

Depending on the desired application, in one preferred embodiment of the present invention, the expanded PTFE may then be at least partially coated or imbibed with one or more resilient coatings to further enhance the performance of the materials of the present invention.

Without wishing to be bound by theory, it is believed that energy is spread and transferred via the resilient outer region to the interconnected node and fibril structure of the expanded PTFE which absorbs the energy. The strength of the fibrils and their random interconnectedness absorbs the impact by spreading it out to a wider area. The interconnected PTFE/resilient material matrix acts synergistically to absorb the impact by diffusing the energy of impact.

A further advantage of the novel materials of the present invention is that the chemical makeup of expanded PTFE does not support the growth of bacteria, which makes it an ideal material for use as a mouth protector. Moreover, as there are no plasticizers used in this mouthguard composition it is extremely resistant to hardening, as is observed in some of the other mouthguard compositions when in the moist environment of the mouth and there is no problem with plasticizers leaching out. Moreover, the expanded PTFE mouthguards of the present invention can be repeatedly sterilized by boiling and will still retain their shape for reuse.

In a further embodiment of the present invention, the mouthguards may be fitted with a tether or strap to connect them to a fastening point, such as a helmet or the like, to prevent loss, swallowing or choking on the mouthguard by the user.

The geometry of the novel mouthguards of the present invention may be tailored to meet a variety of applications. As mentioned above, the mouthguard is made by extruding an expanded PTFE material in a shape designed to fit dentition. The cross-section of the resulting shape may typically be "U-", or "J-shaped" or a variation thereof.

In a preferred embodiment of the present invention, the extruded expanded PTFE is cut into desired lengths and may be placed over a form resembling dentition, then coated with a resilient material, such as an elastomer, which may then be cured. As mentioned earlier herein, the elastomer is applied by brushing, immersing, or spraying, or the like. Further, the elastomers can be applied in layers to produce the desired stiffness to the outer surface, while the inner surface may receive no or little treatment to maintain its softness.

Figure 6:
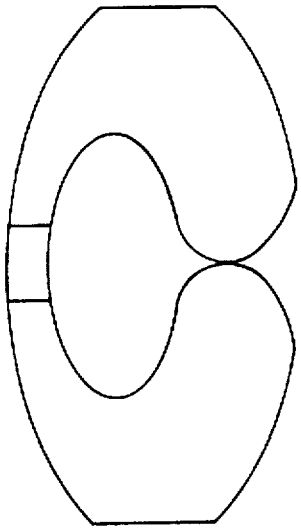
FIG. 6 is a cross-sectional view of an extruded shape prior to separation into two separate "U" shaped channels.
Figure 7:
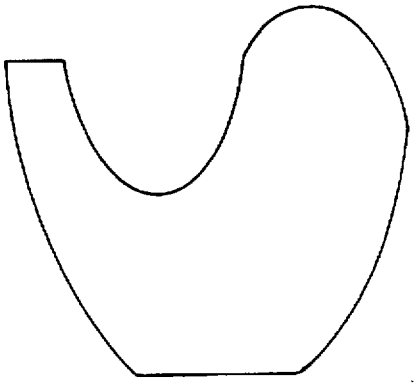
FIG. 7 is a cross-sectional view of a separated portion of the shape shown in FIG. 6.
Figure 8:
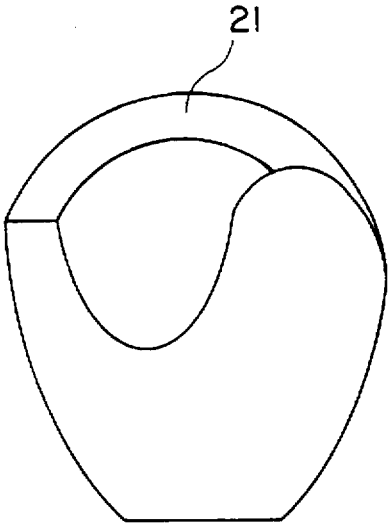
FIG. 8 shows a cross-sectional view of an extruded shape with a sacrificial cap portion.
Figure 9:
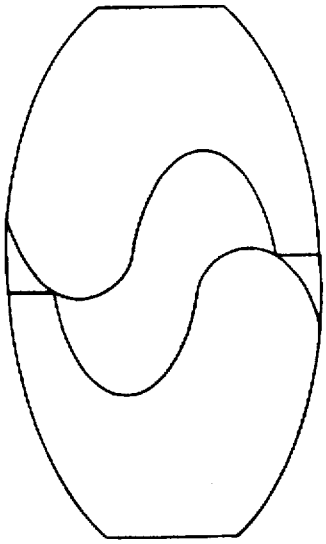
FIG. 9 shows a cross-sectional view of an extruded shape prior to separation wherein the top and bottom sections are symmetrically opposite in geometry.

In another embodiment of the present invention, the extruded form, whether in a "U-shape" or "J-shape", as mentioned earlier herein, can be extruded in a tubular form. As shown in FIGS. 6–9, the expanded material may be extruded in any number of desirable cross-sections to achieve a suitable mouthguard form. For example, as is shown in FIG. 6, the extruded form may be designed to produce two mouthguards for each section of extrudate that is produced. This may be accomplished, for example, by designing a die to produce an extrudate with a hollow center. Surrounding this hollow center are the two shapes which comprise identical mirror images of one another, or in other words, the shapes are 180 degrees opposite from the symmetry plane. This tubular extruded shape is then longitudinally slit leaving the desired mouthguard cross-sectional configuration. FIG. 7 shows a representative cross-section of the two mouthguards formed upon separation of the tube shown in FIG. 6. Alternatively, depending on the desired configuration, a single mouthguard extrudate may be formed having a cap material 21 which may be discarded or repositioned upon slitting of the extruded tube. An advantage obtained by extruding a tubular form in the manners described above is that the outside skin can be locked and slightly hardened by, for example, localized heating, coating or imbibing with a resilient material, etc., while maintaining the inside portion unlocked and softer.

EXAMPLE 1

An expanded PTFE extrudate having a cross-sectional shape as shown in FIG. 6, measuring about 15.9 mm (0.625 inch) at the widest width and approximately 35 mm (1.375 inch) high with a center oval having an approximate major radius of 9 mm (0.35 inch) and an approximate minor radius of 4.4 mm (0.17 inch) was formed and expanded in accordance with the teachings of U.S. Pat. Nos. 3,953,566; 3,962,153; 4,096,227; and 4,187,390 to form a precursor material.

The precursor material was longitudinally slit at the junction of the two mirror image sections. Pieces measuring about 12.7 mm (5 inches) long were cut from the longer lengths of the precursor material. These shorter pieces were placed over a U-shaped mandrel that resembled a dental arch. The outward surface was coated using a brush with a one-part solventless silicone elastomer (Dow Corning® Q1-4010 Conformal Coating, Dow Corning Corporation, Midland, Mich.). The coating was allowed to cure by placing in an oven at about 100° C. for about 12 hours. Upon removal from the mandrel, the mouthguard maintained a U-shaped configuration.

The inner sections of the mouthguard which were not coated with the conformal coating of elastomer maintained the characteristics of the expanded PTFE, while the outward surface was stiffer due to the elastomer coating. The lengths of the sides were trimmed with a razor blade to produce a smooth finished edge.

EXAMPLE 2

A precursor material was formed and placed over a U-shaped mandrel that resembled a dental arch, substantially as described in Example 1.

The outward surface of the precursor material was coated using a brush with an air drying one-part silicone material (Dow Corning® 92-009 Dispersion Coating, Dow Corning Corporation, Midland, Mich.). The coating was allowed to cure by air curing for 24 hours at about 50% relative humidity. Upon removal from the mandrel, the mouthguard maintained a U-shaped configuration.

The inner sections of the mouthguard which were not coated with the conformal coating of elastomer maintained the characteristics of the expanded PTFE, while the outward surface was stiffer due to the elastomer coating. The lengths of the sides were trimmed with a razor blade to produce a smooth finished edge.

EXAMPLE 3

A precursor material was formed and placed over a U-shaped mandrel that resembled a dental arch, substantially as described in Example 1.

The outward surface of the precursor material was coated using a brush with an air drying one-part silicone material (GE RTV863 Silicone Rubber, General Electric Company, Waterford, N.Y.). The coating was allowed to air cure at ambient temperature for 24 hours. Upon removal from the mandrel, the mouthguard maintained a U-shaped configuration.

The inner sections of the mouthguard which were not coated with the conformal coating of elastomer maintained the characteristics of the expanded PTFE, while the outward surface was stiffer due to the elastomer coating. The lengths of the sides were trimmed with a razor blade to produce a smooth finished edge.

EXAMPLE 4

A precursor material was formed and placed over a U-shaped mandrel that resembled a dental arch, substantially as described in Example 1.

The outward surface of the U-shaped precursor material was then coated using a brush with an air drying one-part silicone material (Dow Corning®92-009 Dispersion Coating, Dow Corning Corporation, Midland, Mich.). The silicone coating was allowed to air cure at 50% relative humidity for 24 hours. A second coating of silicone rubber (GE RTV863 Silicone Rubber, General Electric Company, Waterford, N.Y.) was then brush-coated onto the surface of the mouthguard containing the first coating and air cured at ambient temperature for 24 hours. Upon removal from the mandrel, the mouthguard maintained a U-shaped configuration.

The inner sections of the mouthguard which were not coated with the conformal coating of elastomer maintained the characteristics of the expanded PTFE, while the outward surface was stiffer due to the elastomer coating. The lengths of the sides were trimmed with a razor blade to produce a smooth finished edge.

While the above examples focus on cold formable mouthguards incorporating resilient materials comprising silicones, it should be understood that silicone is only one of many possible resilient materials which may be coated onto and/or impregnated into an expanded PTFE structure in accordance with the present invention in order to provide novel mouthguards of the resulting materials. Also various combinations may be used. For example, silicone may be used to provide excellent resilient characteristics, while fluorosilicone elastomers or other chemically resistant materials may be used as a final coating for an article manufactured according to the methods taught in this disclosure.

While particular embodiments of the present invention have been illustrated and described herein, the present invention should not be limited to such illustrations and descriptions. It should be apparent that changes and modifications may be incorporated and embodied as part of the present invention within the scope of the following claims.

We claim:

1. A mouthguard comprising a U-shaped structure with inner and outer walls comprising an expanded PTFE material, said mouthguard adapted to extend at least partially over the dental arch.

2. The mouthguard of claim 1, wherein the said mouthguard is formable to the dentition of a wearer at room temperature.

3. The mouthguard of claim 1, wherein said mouthguard further comprises at least one coating on at least a portion of the surface of the mouthguard.

4. The mouthguard of claim 3, wherein said coating comprises at least one elastomeric material.

5. The mouthguard of claim 1, wherein said mouthguard further comprises at least one insert in at least a portion of said mouthguard.

6. The mouthguard of claim 1, wherein said further comprises an outer shell of a material other than expanded PTFE which surrounds at least a portion of said expanded PTFE material.

7. The mouthguard of claim 1, wherein said expanded PTFE further comprises at least one filler within at least a portion thereof.

8. The mouthguard of claim 1, wherein said mouthguard further includes printing on at least a portion of the surface thereof.

9. The mouthguard of claim 7, wherein said filler comprises at least one material selected from the group consisting a coloring material, a texturing material, and a flavoring material.

10. A cold formable mouthguard comprising a U-shaped structure with inner and outer walls comprising:

an interior region and an exterior region, wherein said interior region comprises an expanded PTFE material which is formable to the dentition of a wearer at room temperature.

11. The mouthguard of claim 10, wherein said exterior region comprises at least one coating.

12. The mouthguard of claim 11, wherein said coating comprises at least one elastomeric material.

13. The mouthguard of claim 10, wherein said mouthguard further comprises at least one insert in at least a portion of said interior portion.

14. The mouthguard of claim 10, wherein said expanded PTFE further comprises at least one filler within at least a portion thereof.

15. The mouthguard of claim 10, wherein said mouthguard further includes printing on at least a portion of the surface thereof.

16. A method of forming a mouthguard comprising:

forming an expanded PTFE material having inner and outer walls and a cross-section which is capable of receiving and conforming to the dentition of a wearer, and shaping said expanded PTFE material into a shape which conforms to the dental arch of the wearer.

17. The method of claim 16, further comprising coating at least portion of the surface of the mouthguard with a resilient coating.

18. The method of claim 16, further comprising providing at least one filler material in said expanded PTFE material.

19. The method of claim 16, further comprising placing at least one material selected from the group consisting of at least one insert and at least one shell material in contact with said expanded PTFE material.

* * * * *